US009243501B2

(12) United States Patent
Thomen et al.

(10) Patent No.: US 9,243,501 B2
(45) Date of Patent: Jan. 26, 2016

(54) TURBINE AIRFOIL PLATFORM RAIL WITH GUSSET

(75) Inventors: Seth J. Thomen, Colchester, CT (US); Edward F. Pietraszkiewicz, Southington, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 616 days.

(21) Appl. No.: 13/609,994

(22) Filed: Sep. 11, 2012

(65) Prior Publication Data

US 2014/0072436 A1 Mar. 13, 2014

(51) Int. Cl.
*F01D 5/14* (2006.01)

(52) U.S. Cl.
CPC ..... *F01D 5/147* (2013.01); *F05D 2240/80* (2013.01)

(58) Field of Classification Search
CPC ..... F01D 5/14; F01D 5/147; F01D 5/225; F05D 2240/80
See application file for complete search history.

(56) References Cited

U.S. PATENT DOCUMENTS

| | | | | |
|---|---|---|---|---|
| 2,967,043 | A * | 1/1961 | Dennis | 416/221 |
| 4,019,832 | A * | 4/1977 | Salemme et al. | 416/135 |
| 4,595,340 | A | 6/1986 | Klassen et al. | |
| 5,135,354 | A * | 8/1992 | Novotny | 415/115 |
| 5,350,277 | A * | 9/1994 | Jacala et al. | 416/90 R |
| 5,443,365 | A | 8/1995 | Ingling et al. | |
| 5,611,197 | A * | 3/1997 | Bunker | 60/806 |
| 6,158,962 | A * | 12/2000 | Lee et al. | 416/193 A |
| 6,190,130 | B1 * | 2/2001 | Fukue et al. | 416/97 R |
| 6,341,939 | B1 * | 1/2002 | Lee | 416/97 R |
| 7,037,078 | B2 * | 5/2006 | Soupizon et al. | 416/203 |
| 7,186,089 | B2 * | 3/2007 | Liang | 416/193 A |
| 7,322,797 | B2 * | 1/2008 | Lee et al. | 416/193 A |
| 7,399,163 | B2 * | 7/2008 | Bil et al. | 416/193 A |
| 7,416,391 | B2 * | 8/2008 | Veltre et al. | 416/97 R |
| 7,458,779 | B2 * | 12/2008 | Bil et al. | 416/190 |
| 8,231,348 | B2 * | 7/2012 | Torii et al. | 416/97 R |
| 8,641,368 | B1 * | 2/2014 | Liang | 415/115 |
| 2006/0269409 | A1 * | 11/2006 | Torii et al. | 416/97 R |
| 2009/0202339 | A1 * | 8/2009 | Torii et al. | 415/115 |
| 2011/0268582 | A1 | 11/2011 | Riazantsev et al. | |
| 2014/0072436 | A1 * | 3/2014 | Thomen et al. | 416/219 R |
| 2014/0212292 | A1 * | 7/2014 | Xu | 416/193 A |

FOREIGN PATENT DOCUMENTS

| | | | |
|---|---|---|---|
| JP | 07189604 | A * | 7/1995 |
| JP | 07247802 | A * | 9/1995 |
| JP | 07310502 | A | 11/1995 |

OTHER PUBLICATIONS

International Preliminary Report on Patentability for International Application No. PCT/US2013/058289 mailed Mar. 26, 2015.

* cited by examiner

*Primary Examiner* — Ninh H Nguyen
*Assistant Examiner* — Christopher R Legendre
(74) *Attorney, Agent, or Firm* — Carlson, Gaskey & Olds, P.C.

(57) ABSTRACT

A blade for a gas turbine engine includes a shank interconnecting a root and a platform, and an airfoil extending radially from the shank. The shank includes a pocket with the platform overhanging the pocket. A rail extends axially along a lateral edge of the platform and extends radially inward from the platform in a direction opposite the airfoil. A gusset extends from an underside of the platform facing the pocket and in a circumferential direction between the rail and the shank.

3 Claims, 2 Drawing Sheets

TURBINE AIRFOIL PLATFORM RAIL WITH GUSSET

BACKGROUND

This disclosure relates to an airfoil having a shank-supported platform, for example, for an industrial gas turbine engine.

Industrial gas turbine blades include a shank that is provided between the blade root and a platform that supports the blade airfoil. One type of turbine blade includes lateral pockets provided in the shank radially beneath the platform. A rail has been used to stiffen the platform to avoid platform cracking due to thermal mechanical fatigue. The rail extends in an axial direction and radially inward from the platform in a direction opposite the airfoil.

A typical turbine blade does not include such rails. Instead, one type of military turbine blade incorporates a gusset that extends from the underside of the platform perpendicularly from the pocket toward a lateral edge of the platform. The gusset has a uniform thickness and is recessed a significant amount from the lateral edge.

SUMMARY

In one exemplary embodiment, a blade for a gas turbine engine includes a shank interconnecting a root and a platform, and an airfoil extending radially from the shank. The shank includes a pocket with the platform overhanging the pocket. A rail extends axially along a lateral edge of the platform and extends radially inward from the platform in a direction opposite the airfoil. A gusset extends from an underside of the platform facing the pocket and in a circumferential direction between the rail and the shank.

In a further embodiment of any of the above, the airfoil includes a pressure side that is a same side of the blade as the gusset.

In a further embodiment of any of the above, the shank includes forward and aft walls spaced axially from one another. The pocket provides a depression between and adjoins the forward and aft walls.

In a further embodiment of any of the above, the gusset is arranged axially intermediately with respect to the forward and aft walls.

In a further embodiment of any of the above, the rail is normal to the platform.

In a further embodiment of any of the above, the gusset is interconnected to at least one of the rail and a surface of the pocket.

In a further embodiment of any of the above, the gusset interconnects a surface of the pocket and the rail.

In a further embodiment of any of the above, the gusset is spaced from the rail.

In a further embodiment of any of the above, the gusset is spaced from the pocket surface.

In a further embodiment of any of the above, the gusset includes a substantially uniform radial thickness.

In a further embodiment of any of the above, the gusset includes a variable radial thickness.

In a further embodiment of any of the above, the thickness is tapered radially.

In a further embodiment of any of the above, the gusset includes an axial width in the range of 0.10 to 1.00 inch (2.54 to 25.40 mm).

In another exemplary embodiment, a gas turbine engine includes compressor and turbine sections. A combustor is provided axially between the compressor and turbine sections. A turbine blade in the turbine section includes a shank interconnecting a root and a platform, and an airfoil extending radially from the shank. The shank includes a pocket with the platform overhanging the pocket. A rail extends axially along a lateral edge of the platform and extends radially inward from the platform in a direction opposite the airfoil. A gusset extends from an underside of the platform facing the pocket and in a circumferential direction between the rail and the shank.

In a further embodiment of any of the above, the gas turbine engine includes a generator operatively coupled to the gas turbine engine, which is a ground-based industrial gas turbine engine. The gas turbine engine includes a power grid operatively connected to the generator.

In a further embodiment of any of the above, the airfoil includes a pressure side that is a same side of the blade as the gusset. The shank includes forward and aft walls spaced axially from one another, and the pocket provides a depression between and adjoining the forward and aft walls. The gusset is arranged axially intermediately with respect to the forward and aft walls, the rail is normal to the platform, and the gusset is interconnected to one of the rail and a surface of the pocket.

BRIEF DESCRIPTION OF THE DRAWINGS

The disclosure can be further understood by reference to the following detailed description when considered in connection with the accompanying drawings wherein.

DETAILED DESCRIPTION

Figure 1:
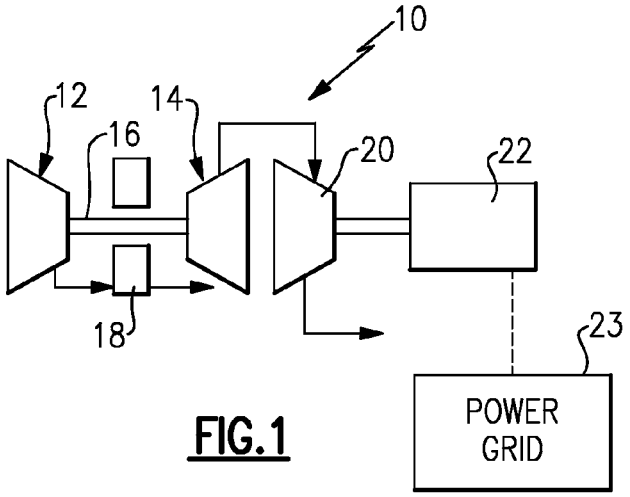
FIG. 1 is a schematic cross-sectional view of an example industrial gas turbine engine.

A schematic view of an industrial gas turbine engine 10 is illustrated in FIG. 1. The engine 10 includes a compressor section 12 and a turbine section 14 interconnected to one another by a shaft 16. A combustor 18 is arranged between the compressor and turbine sections 12, 14. A generator 22 is rotationally driven by a shaft coupled to the turbine or uncoupled via a power turbine, which is connected to a power grid 23. It should be understood that the illustrated engine 10 is highly schematic, and may vary from the configuration illustrated. Moreover, the disclosed airfoil may be used in commercial and military aircraft engines as well as industrial gas turbine engines.

Figure 2:
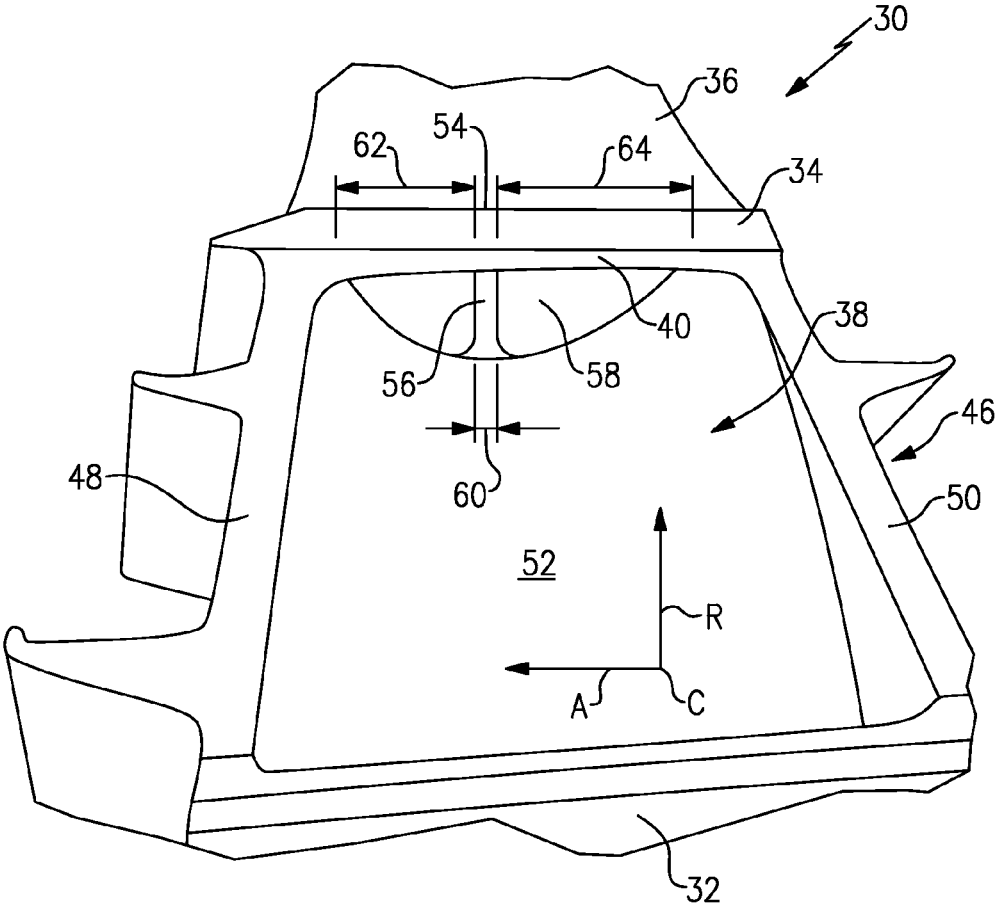
FIG. 2 is a perspective view of an example airfoil with a platform rail and gusset.

The turbine section 14 includes multiple turbine blades, one of which is illustrated at 30 in FIG. 2. In one example, the turbine blade 30 is used in a first stage of the turbine section 14. The turbine blade 30 includes a root 32 configured to be supported by a rotor mounted to the shaft 16. In one example, the root 32 is of a fir tree configuration, as is known in the art. A shank 46 extends radially between and interconnects a platform 34 and the root 32. An airfoil 36 extends in a radial direction R from the platform 34 to a tip (not shown).

Figure 3A:
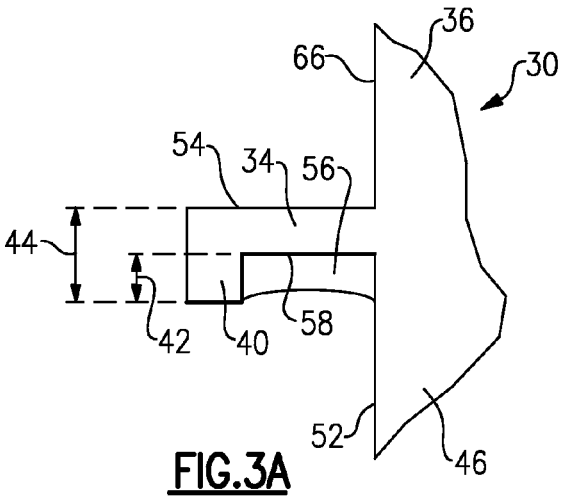
FIG. 3A is a cross-sectional view of the gusset shown in FIG. 2.

The shank 46 includes lateral pockets 38 arranged on the pressure and suction sides of the turbine blade 30. The pressure side is illustrated in FIG. 2, and a pressure side 66 of the airfoil 36 is shown in FIG. 3A. Forward and aft walls 48, 50 are axially spaced apart from one another, with the pocket 38 provided between the walls. The pocket 38 provides a concave surface 52 that extends radially to an underside surface 58 of the platform 34, which is opposite a core flow surface 54 adjacent to the airfoil 36.

A rail 40 extends axially in a direction A along a lateral edge of the platform 34. The rail 40 extends radially inward from the platform 34 in a direction opposite the airfoil 36, as best shown in FIG. 3A. Returning to FIG. 2, a gusset 56 extends from the underside surface 58, which faces the pocket 38, in a circumferential direction C between the rail 40 and the shank 46. In the example, the gusset 56 is normal to the surface 52 and arranged generally intermediately between the forward and aft walls 48, 50. Said another way, first and second distances 62, 64 provided between the gusset 56 and the forward and aft walls 48, 50 are generally equal to one another. The gusset 56 includes an axial thickness 60 in the range of 0.10 to 1.00 inch (2.54 to 25.40 mm). As shown in FIG. 3A, the gusset 56 also includes a radial thickness 42 in the range of 0.10 to 1.00 inch (2.54 to 25.40 mm), and the rail 40 includes a radial height 44 in the range of 0.250 to 1.250 inch (6.35 to 31.75 mm).

In the examples shown in FIGS. 3A-3D, the gusset 56 is interconnected to the underside surface (158 in FIG. 3B; 258 in FIG. 3C; 358 in FIG. 3D) and at least one of the rail 40 and the surface 52. Referring to FIG. 3A, the gusset 56 includes a generally uniform radial thickness 42, and the gusset 56 interconnects both the rail 40 and the surface 52.

Figure 3B:
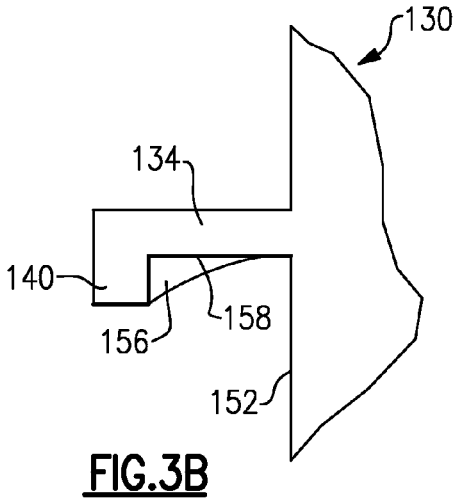
FIG. 3B is a cross-sectional view of another example gusset.

Referring to the turbine blade 130 of FIG. 3B, the gusset 156 extends from the platform 134 and is joined to the rail 140. The gusset 156 tapers to a smaller radial thickness from the rail 140 toward the surface 152. In the example, the gusset 156 is spaced from the surface 152.

Figure 3C:
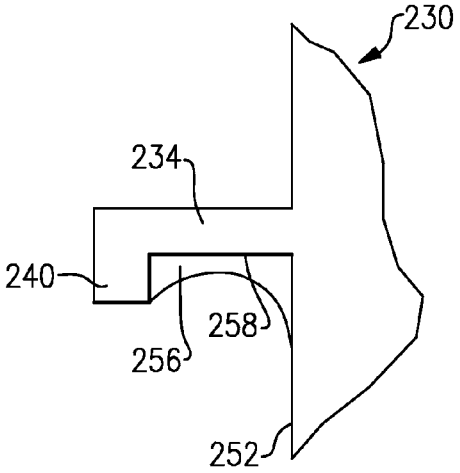
FIG. 3C is a cross-sectional view of still another example gusset.

Referring to the turbine blade 230 of FIG. 3C, the gusset 256 extends from the platform 234 and is interconnected to both the rail 240 and the surface 252. The gusset 256 tapers to a smaller radial thickness from both the rail 240 and the surface 252 toward the center of the gusset 256.

Figure 3D:
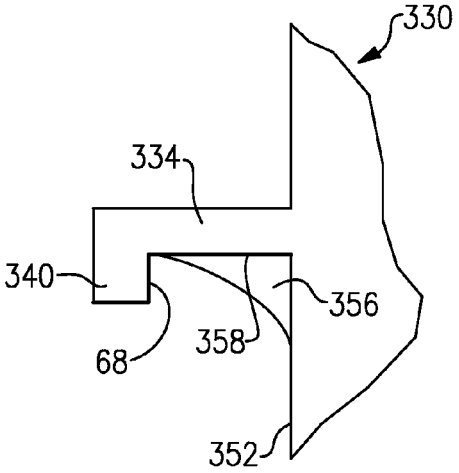
FIG. 3D is a cross-sectional view of yet another example gusset.

Referring to the turbine blade 330 of FIG. 3D, the gusset 356 extends from the platform 334 and is joined to the surface 352. The gusset 356 tapers to a smaller radial thickness from the surface 352 toward the rail 340 and is spaced from an inner surface 68 of the rail 340.

Using a gusset in conjunction with a rail provides improved thermal mechanical fatigue performance by stiffening the platform. The gusset also lowers platform temperatures by acting as a heat sink by drawing heat from the platform down to the pocket where cooling air cools the gusset. The reduction in platform temperature reduces the thermal expansion of the platform, also reducing the potential for platform cracking.

Although an example embodiment has been disclosed, a worker of ordinary skill in this art would recognize that certain modifications would come within the scope of the claims. For that reason, the following claims should be studied to determine their true scope and content.

What is claimed is:

1. A blade for a gas turbine engine comprising:

a shank interconnecting a root and a platform, and an airfoil extending radially from the shank, the shank including a pocket with the platform overhanging the pocket;

a rail extending axially along a lateral edge of the platform and extending radially inward from the platform in a direction opposite the airfoil; and a gusset extending from an underside of the platform facing the pocket and in a circumferential direction between the rail and the shank, wherein the gusset is interconnected to the rail and the platform underside but the gusset is spaced from a surface of the pocket.

2. The blade according to claim 1, wherein the gusset includes a variable radial thickness.

3. The blade according to claim 2, wherein the thickness is tapered radially.

* * * * *